US010427284B2

(12) United States Patent
Kato

(10) Patent No.: US 10,427,284 B2
(45) Date of Patent: Oct. 1, 2019

(54) FASTENER DRIVING TOOL

(71) Applicant: MAKITA CORPORATION, Anjo-shi, Aichi (JP)

(72) Inventor: Itsuku Kato, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 437 days.

(21) Appl. No.: 15/422,036

(22) Filed: Feb. 1, 2017

(65) Prior Publication Data

US 2017/0217004 A1 Aug. 3, 2017

(30) Foreign Application Priority Data

Feb. 2, 2016 (JP) ..... 2016-018126
Feb. 2, 2016 (JP) ..... 2016-018127

(51) Int. Cl.
*B25C 5/15* (2006.01)

(52) U.S. Cl.
CPC ..... *B25C 5/15* (2013.01)

(58) Field of Classification Search
CPC ..... B25C 5/15
USPC ..... 227/2, 107
See application file for complete search history.

(56) References Cited

U.S. PATENT DOCUMENTS 5,957,362 A * 9/1999 Samulowitz ..... A41H 37/00 227/2
8,622,271 B2 * 1/2014 Shima ..... B25C 1/06 227/2
2015/0158160 A1 * 6/2015 Kato ..... B25C 1/047 91/35

FOREIGN PATENT DOCUMENTS

JP H7-033575 U 6/1995
JP 5424105 B2 2/2014

* cited by examiner

*Primary Examiner* — Robert F Long
(74) *Attorney, Agent, or Firm* — Oliff PLC

(57) ABSTRACT

A fastener driving tool is provided with a plunger, an impact spring, a motor, a drive mechanism, a motor drive control unit, a position detection unit, and a timer unit. The drive mechanism moves the plunger from a stop position to top dead center by rotation of the motor. The impact spring moves the plunger in a driving direction. The position detection unit detects that the plunger has reached a predetermined position by the rotation of the motor, and the timer unit measures time therebetween. The motor drive control unit, after power supply to the motor is cut off, performs a stop control for stopping the motor at the predetermined stop position based on the time measured by the timer unit.

19 Claims, 12 Drawing Sheets

FIG.6

| BATTERY VOLTAGE | TIME T1 | TIME T2 | TIME T3 | | TIME T4 |
|---|---|---|---|---|---|
| | LOWER LIMIT ~ UPPER LIMIT | | REFERENCE | CORRECTION AMOUNT | |
| 20V ~ | 50ms ~ 70ms | 100ms | 30ms | 1ms/1ms | 50ms |
| 18 ~ 20V | 55ms ~ 75ms | 103ms | 30ms | 1ms/1ms | 50ms |
| 16 ~ 18V | 65ms ~ 89ms | 105ms | 30ms | 1ms/1ms | 50ms |
| 14 ~ 16V | 70ms ~ 96ms | 110ms | 30ms | 2ms/1ms | 50ms |
| 12 ~ 14V | 80ms ~ 110ms | 115ms | 30ms | 2ms/1ms | 50ms |
| 10 ~ 12V | 95ms ~ 125ms | 122ms | 30ms | 2ms/1ms | 50ms |
| 8 ~ 10V | 100ms ~ 134ms | 130ms | 30ms | 3ms/1ms | 50ms |
| ~ 8V | 110ms ~ 146ms | 145ms | 30ms | 4ms/1ms | 50ms |

FIG.9

| BATTERY VOLTAGE | TIME T1 | TIME T2 | TIME T3 | TIME T4 | | BRAKE FORCE (PWM) |
|---|---|---|---|---|---|---|
| | LOWER LIMIT ~ UPPER LIMIT | | | REFERENCE | CORRECTION AMOUNT | |
| 20V ~ | 50ms ~ 70ms | 100ms | 30ms | 50ms | 2ms/1ms | 100% |
| 18 ~ 20V | 55ms ~ 75ms | 103ms | 30ms | 50ms | 2ms/1ms | 100% |
| 16 ~ 18V | 65ms ~ 89ms | 105ms | 30ms | 45ms | 2ms/1ms | 100% |
| 14 ~ 16V | 70ms ~ 96ms | 110ms | 30ms | 45ms | 1ms/1ms | 100% |
| 12 ~ 14V | 80ms ~ 110ms | 115ms | 30ms | 45ms | 1ms/1ms | 100% |
| 10 ~ 12V | 95ms ~ 125ms | 122ms | 30ms | 40ms | 1ms/1ms | 100% |
| 8 ~ 10V | 100ms ~ 134ms | 130ms | 30ms | 40ms | 1ms/2ms | 100% |
| ~ 8V | 110ms ~ 146ms | 145ms | 30ms | 35ms | 1ms/3ms | 100% |

FIG.11

| BATTERY VOLTAGE | TIME T1 | TIME T2 | TIME T3 | TIME T4 | BRAKE FORCE (PWM) | |
|---|---|---|---|---|---|---|
| | LOWER LIMIT ~ UPPER LIMIT | | | | REFERENCE | CORRECTION AMOUNT |
| 20V ~ | 50ms ~ 70ms | 100ms | 30ms | 50ms | 70% | 4% / 1ms |
| 18 ~ 20V | 55ms ~ 75ms | 103ms | 30ms | 50ms | 70% | 4% / 1ms |
| 16 ~ 18V | 65ms ~ 89ms | 105ms | 30ms | 50ms | 65% | 3% / 1ms |
| 14 ~ 16V | 70ms ~ 96ms | 110ms | 30ms | 50ms | 60% | 3% / 1ms |
| 12 ~ 14V | 80ms ~ 110ms | 115ms | 30ms | 50ms | 55% | 2% / 1ms |
| 10 ~ 12V | 95ms ~ 125ms | 122ms | 30ms | 50ms | 50% | 2% / 1ms |
| 8 ~ 10V | 100ms ~ 134ms | 130ms | 30ms | 50ms | 45% | 1% / 1ms |
| ~ 8V | 110ms ~ 146ms | 145ms | 30ms | 50ms | 40% | 1% / 1ms |

FASTENER DRIVING TOOL

CROSS-REFERENCE TO RELATED APPLICATIONS

This application claims the benefit of Japanese Patent Application Nos. 2016-18126 and 2016-18127 both filed Feb. 2, 2016 in the Japan Patent Office, and the entire disclosures of Japanese Patent Application Nos. 2016-18126 and 2016-18127 are incorporated herein by reference.

BACKGROUND

The present disclosure relates to an electric fastener driving tool driven by a motor.

As a fastener driving tool for driving a pin or a staple into a wooden material or a gypsum board, a tool is known that is configured to move an impact driver against a biasing force of an impact spring and then release the impact spring to perform driving.

This type of fastener driving tool is provided with a plunger that can reciprocate along a driving direction and is biased in the driving direction by the impact spring. The impact driver is fixed to the plunger.

Usually, the plunger is stopped at a position away from bottom dead center at which a driving target (pin, staple, etc.) is driven by the impact driver. When a driving command is input, the plunger is moved in a direction opposite to bottom dead center via a motor and a drive mechanism having an anti reverse rotation function.

When the plunger reaches top dead center that is farthest from bottom dead center, the plunger and the drive mechanism are disengaged from each other. The plunger (and the impact driver) is instantaneously moved toward bottom dead center by the biasing force of the spring, and the driving target is driven into a substrate (wooden material, gypsum board, etc.).

The driving operation as such is achieved by driving the motor. The plunger is stopped at a position away from bottom dead center in each cycle of driving operation.

In order to stop the plunger at a desired stop position, it has been proposed to detect that the plunger has reached top dead center after power supply to the motor is started, and then to supply power to the motor for a certain period of time (see, for example, Japanese Examined Utility Model Application Publication No. H07-33575).

For the same purpose, it has also been proposed to measure time until the plunger reaches top dead center after power supply to the motor is started, and set power supply time of the motor to follow based on the measured time (for example, see Japanese Patent No. 5424105).

SUMMARY

In the conventional fastener driving tool, the power supply time of the motor is controlled to stop the plunger at a desired stop position. Thus, the stop position of the plunger sometimes fluctuates due to rotation of the motor after the power supply is cut off (so-called free-run). Further, if a battery is provided as a power source for driving the motor, the stop position of the plunger may fluctuate due to a drop in battery voltage.

When the stop position of the plunger fluctuates in this way, time from when the power supply to the motor is started in the next cycle until the driving is performed fluctuates. A user may be given a sense of discomfort.

Also, if the stop position fluctuates in each cycle of driving operation, the user may move the fastener driving tool before the driving target is reliably driven into the substrate. In such case, the driving operation may not be satisfactorily performed. On the other hand, in order to reliably drive the driving target, the user may extend time during which the driving target is in contact with the substrate, but such measures deteriorate workability of driving work.

In one aspect of the present disclosure, it is preferable that, in a fastener driving tool, fluctuation of time required for driving due to changes in the stop position of the plunger to which the impact driver is fixed is reduced.

A fastener driving tool according to one aspect of the present disclosure comprises: a plunger that is movable in a driving direction of the driving target; an impact spring that biases the plunger in the driving direction; a motor that moves the plunger in a direction opposite to the driving direction; a drive mechanism; and a motor drive control unit.

The drive mechanism engages with the plunger by rotation of the motor and moves the plunger in the direction opposite to the driving direction. When the plunger reaches top dead center due to the movement, the engagement with the plunger is released. The drive mechanism moves the plunger in the driving direction by the impact spring.

The motor drive control unit starts power supply to the motor in accordance with an external driving command. Then, after power supply to the motor is started, and when the driving target is driven in accordance with the movement of the plunger and motor drive time has elapsed that is required for the plunger to move from bottom dead center to top dead center side, the power supply to the motor is cut off. The bottom dead center is a driving position of the fastener driving tool.

The fastener driving tool further comprises a position detection unit and a timer unit.

The position detection unit detects that the plunger has reached a predetermined position during the power supply to the motor by the motor drive control unit. The time unit measures time after the motor drive control unit starts power supply to the motor until the position detection unit detects that the plunger has reached the predetermined position.

Then, the motor drive control unit, after cutting off the power supply to the motor, performs a stop control to stop the motor at the predetermined stop position based on the time measured by the timer unit.

In other words, the time measured by the timer unit is the time after the power supply to the motor is started until the plunger reaches the predetermined position, and thus corresponds to the stop position of the plunger before the power supply is started.

Therefore, according to the fastener driving tool of the present disclosure, the stop position after the motor is driven can be controlled based on the stop position of the plunger before the power supply is started. Fluctuation of the stop position of the plunger to be stopped in each cycle of driving operation can be reduced.

Therefore, according to the fastener driving tool of the present disclosure, fluctuation of the time from when the user inputs the driving command until the driving target is actually driven can be reduced. Usability of the fastener driving tool can be improved.

Also, since fluctuation of the stop position of the plunger can be reduced, the stop position can be set to be a position close to top dead center. By setting the stop position of the plunger as such, time required for driving can be shortened. Workability of the driving operation can be enhanced.

It should be noted that the driving target may be any member as long as it can be struck by an impact driver fixed to the plunger and can be driven into the substrate, for example, a pin or a staple.

The motor drive control unit may be configured to execute a free-run control to rotate the motor by inertia after the power supply to the motor is cut off and a brake control to generate a brake force to the motor, thereby to perform the stop control.

In this way, the stop position of the plunger can be controlled by the free-run control and the brake control. Further, since the free-run control can quickly bring the plunger close to the stop position and then the brake control can quickly stop the plunger, time after execution of the driving until the plunger stops can be shortened. Therefore, working efficiency upon repetitively performing the driving of the driving target can be improved.

In the stop control, the motor drive control unit may be configured to control at least one of execution time of the free-run control and execution time of the brake control based on the time measured by the timer unit.

In this case, the stop position of the plunger can be controlled simply by controlling the execution time of the free-run control or the execution time of the brake control. Since there is no need to control a power supply time or a power supplying current to the motor, the stop control can be more easily performed.

When the time measured by the timer unit is shorter than a set time, it is considered that the stop position of the plunger is on top dead center side as compared to the predetermined stop position. Conversely, when the time measured by the timer unit is longer than the set time, it is considered that the stop position of the plunger is a position farther from top dead center (in other words, on bottom dead center side) than the predetermined stop position.

Therefore, in the stop control, control operation for controlling the execution time of the free-run control may be set as follows. That is, when the time measured by the timer unit is shorter than a preset set time, the execution time of the free-run control is controlled to be shorter, and when the time measured by the timer unit is longer than the preset set time, the execution time of the free-run control is controlled to be longer.

Also in the stop control, control operation for controlling the execution time of the brake control may be set as follows. That is, when the time measured by the timer unit is shorter than the preset set time, the execution time of the brake control is controlled to be longer, and when the time measured by the timer unit is longer than the preset set time, the execution time of the brake control is controlled to be shorter.

In this way, the stop position of the plunger can be brought close to a desired stop position corresponding to the set time by the execution time of the free-run control or the execution time of the brake control.

In the stop control, the motor drive control unit may be configured to control the brake force generated by the brake control based on the time measured by the timer unit.

Further, in this case, in the stop control, when the time measured by the timer unit is shorter than a preset set time, the brake force may be controlled to be increased, and when the measured time is longer than the preset set time, the brake force may be controlled to be reduced.

In this way, controlling the brake force generated by the brake control can bring the stop position of the plunger close to a desired stop position corresponding to the set time.

The position detection unit can be configured to only detect the plunger position that enables estimation of the stop position of the plunger from the elapsed time after the power supply to the motor is started, and may be configured to detect a specific position during the time after the power supply to the motor is started until the plunger reaches top dead center.

Further, the position detection unit may be configured to detect a specific position during the time from when the plunger reaches top dead center after the power supply to the motor is started until the plunger reaches bottom dead center at which driving is performed.

In addition, the position detection unit may be configured to detect that the plunger has reached top dead center after the power supply to the motor is started. In this case, the position detection unit can be configured using a switch that switches on/off states when the plunger reaches top dead center, so that the configuration thereof can be simplified.

The position detection unit does not necessarily need to directly detect the position of the plunger, but can be configured to detect the specific position of the plunger after the power supply to the motor is started based on a rotation amount or a rotation angle of the motor used for moving the plunger.

Similarly, the position detection unit can be configured to detect the specific position of the plunger after the power supply to the motor is started, based on an amount of position change of a power transmission system from the motor to the plunger.

In the case that a battery is used as a power source for supplying power to the fastener driving tool, the power supplying current to the motor (in other words, a rotation speed of the motor) changes depending on a voltage supplied from the battery (that is, a battery voltage). One having skill in the art will appreciate that the stop position of the plunger may change due to this voltage change.

Therefore, in a fastener driving tool provided with a battery, a battery voltage detection unit that detects a battery voltage may be provided, and the motor drive control unit may be configured to set a set time used in the stop control based on the battery voltage detected by the battery voltage detection unit.

In this way, fluctuation of the stop position of the plunger due to changes in the battery voltage can be reduced.

Also in this case, the motor drive control unit may be configured to prohibit setting of the set time based on the battery voltage when a driving interval of the fastener driving tool is shorter than a set interval, and retain a previous value as the set time.

That is, when the driving interval of the fastener driving tool is shortened, the motor is repeatedly driven in a short time, and the battery voltage fluctuates. Then, if the set time is set in a state in which the battery voltage fluctuates due to driving of the motor, the set time fluctuates in each cycle of driving operation and the stop position of the plunger may change.

Therefore, when the driving interval of the fastener driving tool is shorter than the set interval, for example in a case of repetitive driving, setting of the set time based on the battery voltage is prohibited so that the change of the stop position of the plunger due to fluctuation of the battery voltage can be reduced.

The fastener driving tool according to another aspect of the present disclosure comprises a plunger, an impact spring, a motor, a drive mechanism, and a motor drive control unit, similar to the fastener driving tool described above.

The motor receives power supply from the battery to rotate, and moves the plunger in a direction opposite to a driving direction. Further, the motor drive control unit starts power supply to the motor in accordance with an external driving command, and then, when the plunger moves to top dead center side via top dead center and bottom dead center, which is a driving position of a driving target, the power supply to the motor is cut off.

Further, the fastener driving tool of this aspect comprises a battery voltage detection unit that detects a battery voltage supplied from the battery to the motor. Based on the battery voltage detected by the battery voltage detection unit, the motor drive control unit performs a stop position control to stop the plunger at a predetermined stop position after the power supply to the motor is cut off.

Therefore, according to the fastener driving tool of this aspect, for example, even if the battery voltage is dropped and a driving torque generated during the power supply to the motor is reduced, the stop position of the plunger after the driving operation is completed can be controlled to a predetermined stop position.

Therefore, according to the fastener driving tool of this aspect, fluctuation of time from when a user inputs a driving command until the driving target is actually driven, due to changes in the stop position of the plunger caused by fluctuation of the battery voltage, can be reduced. Usability of the fastener driving tool can be improved.

Also in the fastener driving tool of this aspect, similar to the fastener driving tool of the one aspect described above, because fluctuation of the stop position of the plunger can be reduced, setting the stop position to a position close to top dead center can improve workability of the driving operation.

The stop position controlled by the stop position control may be set in any position on a traveling path of the plunger between bottom dead center and top dead center. Also in the stop position control, the plunger only has to be stopped within an allowable range in which a sense of discomfort is not given to the user.

For this reason, for example, a position detection unit for detecting that the plunger has reached top dead center may be provided. In the stop position control, the drive control of the motor may be performed after the position detection unit detects that the plunger has reached top dead center until the power supply to the motor is cut off.

In other words, if the drive control of the motor after top dead center is detected is performed based on the battery voltage and the power supply to the motor is cut off, the stop position of the plunger can be controlled within the allowable range.

In this case, drive control of the motor may control a motor current based on the battery voltage, or a motor drive time from when the plunger reaches top dead center until the power supply to the motor is cut off may be controlled based on the battery voltage. If the motor drive time is controlled, it is unnecessary to control the motor current. The stop position control can be performed more easily.

If the battery voltage is high, the stop position of the plunger is on top dead center side when the motor drive time is constant. Therefore, when the motor drive time is controlled by the stop position control, it is preferable to control such that the motor drive time becomes shorter as the battery voltage is higher.

In the stop position control, the motor drive control unit may perform a free-run control to rotate the motor by inertia (that is, free-run) after the power supply to the motor is cut off, and control the execution time of the free-run control based on the battery voltage.

In this case, the stop position of the plunger moves to top dead center side as a free-run time becomes longer. Thus, it is preferable to control such that the execution time of the free-run control becomes shorter as the battery voltage is higher (in other words, as a rotation speed when the motor is driven is higher).

In the stop position control, the motor drive control unit may perform a brake control to generate a brake force to the motor after the power supply to the motor is cut off, and a control amount of the brake control may be controlled based on the battery voltage.

In this case, the control amount of the brake control may be controlled such that a brake force generated by the brake control is increased as the battery voltage is higher (in other words, as the rotation speed when the motor is driven is higher).

Examples of the control amount of the brake control that is controlled according to the battery voltage in the stop position control include a brake current flowing to the motor to generate the brake force, the execution time of the brake control, and the like.

Also, when the motor drive control unit starts power supply to the motor, the battery voltage may fluctuate due to rotation of the motor. Therefore, the motor drive control unit may be configured to perform the stop position control based on the battery voltage detected by the battery voltage detection unit before the power supply to the motor is started according to the driving command from the user.

In this way, fluctuation of the stop position of the plunger after the driving operation is ended can be favorably reduced.

Further, the motor drive control unit may be configured to perform the stop position control based on the battery voltage previously used in the stop position control when a driving interval of the driving target based on the driving command is shorter than a set interval.

That is, when the driving interval of the driving target is shortened, the motor is repeatedly operated in a short time, and the battery voltage fluctuates. Then, when the battery voltage is detected and the stop position control is executed in such a state that the battery voltage fluctuates by the drive of the motor, the stop position of the plunger may change.

Therefore, when the driving interval of the driving target is shorter than the set interval, for example in a case of execution of repetitive driving, fluctuation of the stop position of the plunger can be reduced by prohibiting updating the battery voltage used for the stop position control.

BRIEF DESCRIPTION OF THE DRAWINGS

FIG. 6 is an explanatory diagram showing a control map used in a motor drive control process of FIGS. 5A and 5B in one embodiment.

FIG. 9 is an explanatory diagram showing a control map used in a motor drive control process of the first modification.

FIG. 11 is an explanatory diagram showing a control map used in a motor drive control process of the second modification.

DETAILED DESCRIPTION OF THE PREFERRED EMBODIMENTS

Hereinafter, an embodiment of the present disclosure will be described with reference to the accompanying drawings.

Figure 1:
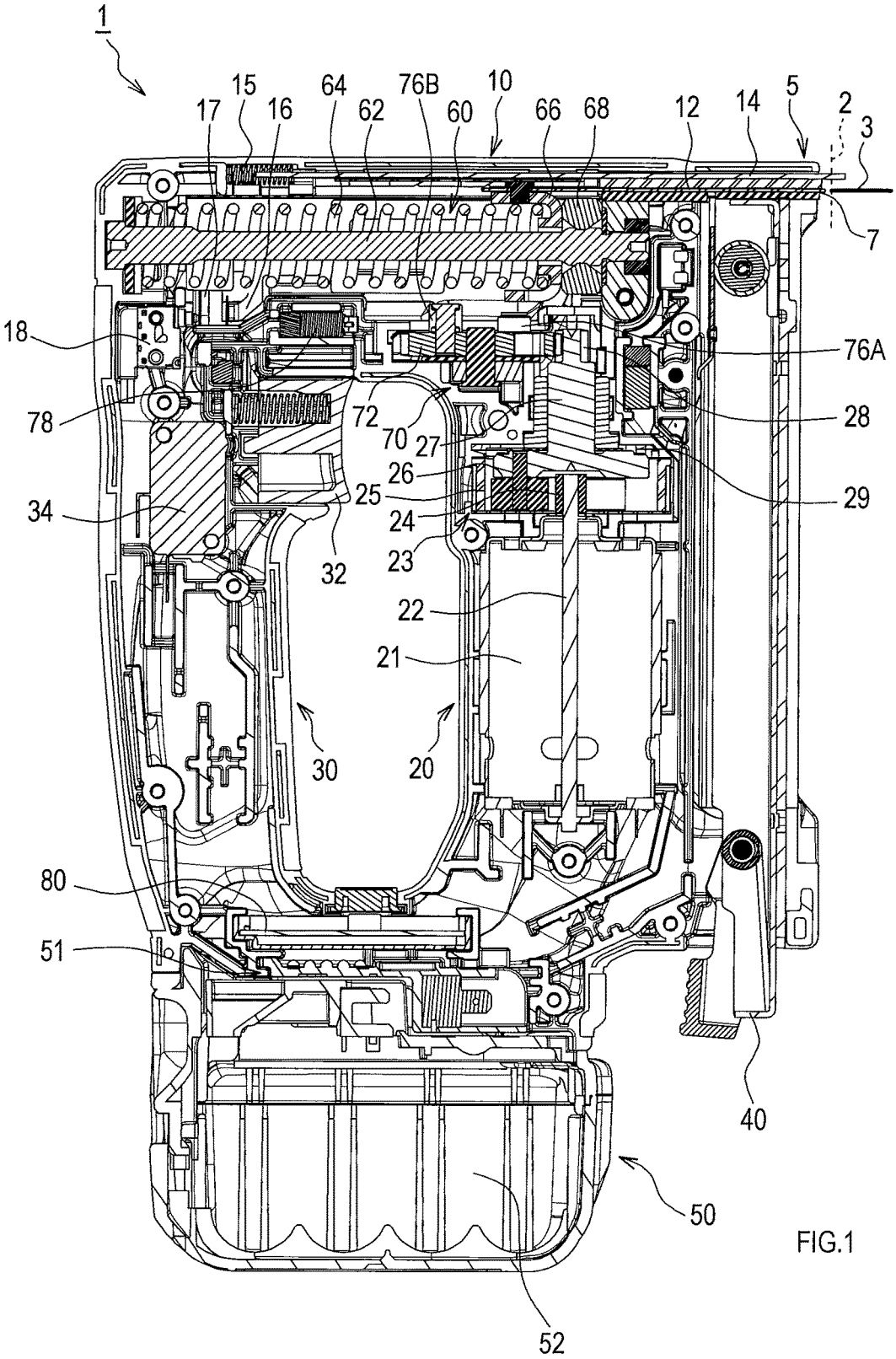
FIG. 1 is a cross-sectional view showing an entire configuration of a fastener driving tool in one embodiment.

As shown in FIG. 1, a fastener driving tool 1 of the present embodiment is for driving a driving target 3 such as a needle or a staple into a substrate 2 such as a wooden material, a gypsum board or the like. The fastener driving tool 1 comprises a tool main body 10, a motor storage 20, a grip part 30, a magazine 40, and a battery pack 50.

The magazine 40 is configured to be able to load a plate-shaped connected driving target in which a large number of driving targets 3 are temporarily fastened in parallel to each other. The magazine 40 feeds the loaded connected driving target to a driving nose 5 in conjunction with driving operation of the tool body 10, thereby to supply the driving targets 3 one by one into a driving path of the driving nose 5.

The driving path is for moving the driving target 3 supplied from the magazine 40 in a direction orthogonal to a direction of supply from the magazine 40 and causing the driving target 3 to eject from an ejection port 7 at a front end of the driving nose 5.

The tool body 10 reciprocates an impact driver 12 along the driving path so that the reciprocation cases the driving target 3 to be supplied from the magazine 40 into the driving path, and that the impact driver 12 strikes the driving target 3 to be ejected from the ejection port 7.

To this end, the tool body 10 comprises an impact mechanism 60 for reciprocating the impact driver 12 along the driving path, and a drive mechanism 70 for driving the impact mechanism 60 by rotation of a motor 21 accommodated in the motor storage 20.

The impact mechanism 60 comprises a round bar-shaped support 62 assembled in the tool body 10 so that a center axis of the support 62 is parallel to a moving direction of the impact driver 12, an impact spring 64 provided around the support 62, and a plunger 66 to which the impact driver 12 is coupled.

The impact spring 64 is composed of a coil spring, one end of which is fixed to the support 62 of the tool body 10, and the plunger 66 is fixed to the other end. The plunger 66 has a hole through which the support 62 is inserted. Insertion of the support 62 into the hole allows the plunger 66 to move in an axial direction of the support 62.

Therefore, the plunger 66 is biased toward the driving nose 5 by the impact spring 64. The plunger 66, when moving toward the driving nose 5 by a biasing force of the impact spring 64, is brought into contact with a resilient rubber damper 68 and stops.

In this stop position (that is, bottom dead center), as shown in FIG. 1, a front end of the impact driver 12 protrudes from the ejection port 7 of the driving nose 5, and pushes the driving target 3 supplied from the magazine 40 toward the substrate 2. The damper 68 absorbs impact generated when the plunger 66 is brought into contact.

The drive mechanism 70 moves the plunger 66 of the impact mechanism 60 to a rear end position (that is, top dead center) opposite to the driving nose 5 against the biasing force of the impact spring 64, thereby compressing the spring 64 and then releasing the impact spring 64.

When the plunger 66 moves to top dead center by the drive mechanism 70 and the impact spring 64 is released, the plunger 66 instantaneously moves from top dead center towards bottom dead center by the biasing force of the impact spring 64, and strikes the impact driver 12 toward the nose 5.

As a result, the impact driver 12 drives the driving target 3 into the substrate 2. A configuration of the drive mechanism 70 will be described later.

The drive mechanism 70 is disposed opposite to the impact driver 12 across the plunger 66 of the impact mechanism 60, in the tool body 10. The motor storage 20 is disposed to interpose the drive mechanism 70 between the motor storage 20 and the impact mechanism 60.

The motor 21 is accommodated in a housing of the motor storage 20 so that a rotation shaft 22 is orthogonal to the moving direction of the impact driver 12 and a front end of the rotation shaft 22 protrudes toward the drive mechanism 70.

Further, the magazine 40 is disposed along the tool body 10 and the motor storage 20, starting from the driving nose 5. The grip part 30 is disposed opposite to the magazine 40 of the motor storage 20 across a space for a user's hand to be put in.

The grip part 30 extends in the same direction as the motor storage 20 from a rear end of the tool body 10 positioned opposite to the plunger 66, and can be grasped with one hand as the user places a hand in the space between the motor storage 20 and the grip part 30.

A flat plate-shaped battery mounting part 51 for mounting the battery pack 50 is provided at an end of each of the grip part 30 and the motor storage 20 opposite to the tool body 10 so as to connect these parts.

A housing of the tool body 10, the motor storage 20, the grip part 30, and the battery mounting part 51 is integrally formed of a synthetic resin, as half housings formed by being split into two by a plane that a center axis 22 of the motor 21 and a center axis of the support 62 pass through.

The half housings are coupled to one another by a plurality of fixing screws. Inside thereof, the motor 21, the impact mechanism 60, the drive mechanism 70, etc. described above are accommodated.

An outer wall of the battery mounting part 51 opposite to the tool body 10 is a mounting surface of the battery pack 50. On the mounting surface, a rail part for mechanically coupling the battery pack 50, and positive and negative terminal plates for electrical connection, are arranged.

The battery pack 50, incorporates for example, a lithium ion battery (hereafter referred to as battery) 52 having an output voltage of 14.4 V, which can be removed from the battery mounting part 51 and charged with a charger to be used repeatedly. The battery pack 50 can also be utilized as a power source of an electric power tool other than the fastener driving tool 1, such as, for example, a rechargeable screw driver or a cutting tool.

Further, the battery mounting part 51 accommodates a controller 80 comprising a control circuit 90 for controlling operation of the motor 21, a power supply circuit 85 (see FIG. 3) for supplying a power supply voltage (DC constant voltage) Vcc to the control circuit 90, and so on.

The grip part 30 is provided with a trigger-type lever 32 at a portion protruding from the tool body 10 and facing the motor storage 20, so that the user can perform a pulling operation with a finger while holding the grip part 30.

In the rear of the lever 32, a trigger switch 34 is provided which is turned on when the lever 32 is pulled and a contact point is depressed.

Further, the tool body 10 is provided with an elongated contact arm 14 in parallel to the impact driver 12. The contact arm 14 is accommodated in a detection passage provided in the tool body 10 so as to be parallel to a drive passage through which the impact driver 12 can reciprocate, and can reciprocate in the same direction as the impact driver 12.

The contact arm 14 is for detecting that the driving nose 5 is brought into contact with the substrate 2 and driving of the driving target 3 has become available.

Therefore, the contact arm 14 is biased toward the driving nose 5 by the coil spring 15 in the tool body 10. Normally, the contact arm 14 is held in a state in which an end opposite to the coil spring 15 protrudes from the driving nose 5.

The contact arm 14, when brought into contact with the substrate 2, is pushed into the tool body 10 by the substrate 2.

The tool body 10 is provided with a contact arm switch 18 for detecting, from the position change of the contact arm 14, that driving of the driving target 3 has become available.

Further, an arm part 16 for switch depression is provided at a rear end of the contact arm 14 on the coil spring 15 side. When the contact arm 14 moves into the tool body 10 against a biasing force of the coil spring 15, the arm part 16, via a leaf spring 17, depresses a contact point of the contact arm switch 18.

Accordingly, the contact arm switch 18 is turned on when the driving nose 5 is brought into contact with the substrate 2, and the driving target 3 can be securely driven into the substrate 2.

The contact arm switch 18 and the trigger switch 34 are connected to the controller 80. The controller 80, when the both switches are in the on state at the same time, determines that a driving command is input, and starts driving the motor 21.

Next, a description will be given on the drive mechanism 70.

Figure 2:
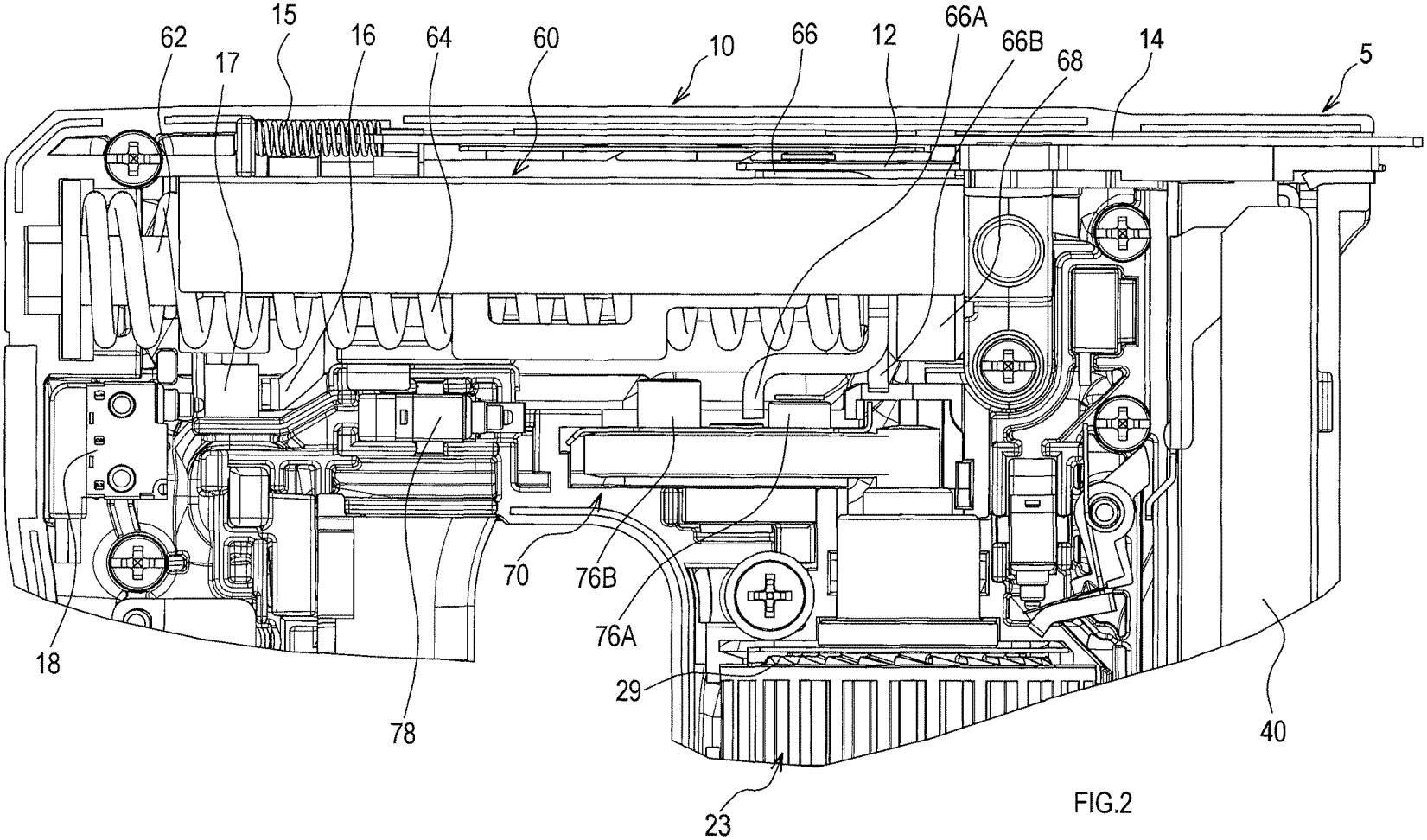
FIG. 2 is an explanatory view showing an outer appearance around a plunger of the fastener driving tool in one embodiment.

As shown in FIGS. 1 and 2, a deceleration mechanism 23 is provided at a rotation shaft 22 of the motor 21, and rotation of the motor 21 is transmitted to the drive mechanism 70 via the deceleration mechanism 23.

The deceleration mechanism 23 comprises a pinion gear 24 fixed to the rotation shaft 22 of the motor 21, an internal teeth ring gear 25 fixed to the housing of the motor storage 20, a planetary gear 26 provided between the pinion gear 24 and the internal teeth ring gear 25, and an output shaft 27 that transmits power to the drive mechanism 70.

The output shaft 27 is rotatably provided around an axis concentric to the motor 21, and is provided, at a position deviated from the rotation center axis, with a large diameter part to which a rotation shaft of the planetary gear 26 is fixed and a small diameter part protruding toward the drive mechanism 70. The small diameter part is configured as a pinion gear 28 for transmitting power to the drive mechanism 70.

In the deceleration mechanism 23, rotation of the motor 21 (pinion gear 24 in other words) causes the planetary gear 26 to revolve around the rotation shaft 22 of the motor 21, and rotates the output shaft 27 at a lower speed than the motor 21.

Therefore, the rotation of the motor 21 is transmitted to the drive mechanism 70 at a reduced speed, via the pinion gear 28 formed on the small diameter part of the output shaft 27.

Between the large diameter part of the output shaft 27 and a case of the deceleration mechanism 23 (in other words, the housing of the motor storage 20), a one-way clutch 29 is provided that allows rotation in one direction of the output shaft 27 corresponding to the rotation while the motor 21 is driven, and prohibits rotation in the opposite direction.

The drive mechanism 70 has a spur gear 72 that meshes with the pinion gear 28 of the deceleration mechanism 23.

The spur gear 72 is rotatably fixed about an axis parallel to the rotation shaft 22 of the motor 21 (in other words, about an axis perpendicular to the center axis of the support 62 of the impact mechanism 60) inside the housing of the tool body 10.

Then, on a plate surface of the spur gear 72, two pins 76A, 76B are provided at positions having a predetermined angle with respect to a center axis of the spur gear 72. The pins 76A, 76B protrude toward the impact mechanism 60 from the plate surface of the spur gear 72. A height of the pin 76B is higher than that of the pin 76A.

These pins 76A, 76B respectively engage with protrusions 66A, 66B protruding from the plunger 66 of the impact mechanism 60 toward the drive mechanism 70 by rotation of the spur gear 72 to compress the impact spring 64, and moves the plunger 66 toward top dead center.

Therefore, a roller is provided around the pin 76A, 76B, so that the compressing of the impact spring 64 is performed smoothly.

The protrusion 66B protrudes from a lower end of the plunger 66 on the damper 68 side, and the protrusion 66A protrudes from an upper end of the plunger 66 on the side opposite to the damper 68. An amount of protrusion from the plunger 66 is larger in the protrusion 66A than in the protrusion 66B.

An angle of arrangement of the pins 76A, 76B with respect to the center axis of the spur gear 72 is set such that the pin 76A engages with the protrusion 66A by the rotation of the spur gear 72 to compress the impact spring 64 and then the pin 76B engages with the protrusion 66B to further compress the impact spring 64.

Therefore, when the pin 76B engages with the protrusion 66B to compress the impact spring 64, and the plunger 66 reaches top dead center, these engagements are released. When these engagements are released, the impact spring 64 is released, so that the plunger 66 is moved to bottom dead center by the biasing force of the impact spring 64, and the impact driver 12 strikes the driving target 3.

The tool body 10 is provided with top dead center detection switch 78, as a position detection unit of the present disclosure that is brought into contact with the protrusion 66A to be turned on when the plunger 66 reaches the vicinity of top dead center. A detection signal from top dead center detection switch 78 is also input to the controller 80.

Therefore, the controller 80 can detect that driving by the impact driver 12 has been performed, when top dead center detection switch 78 is changed from an on state to an off state.

Next, a description will be given on the controller 80.

Figure 3:
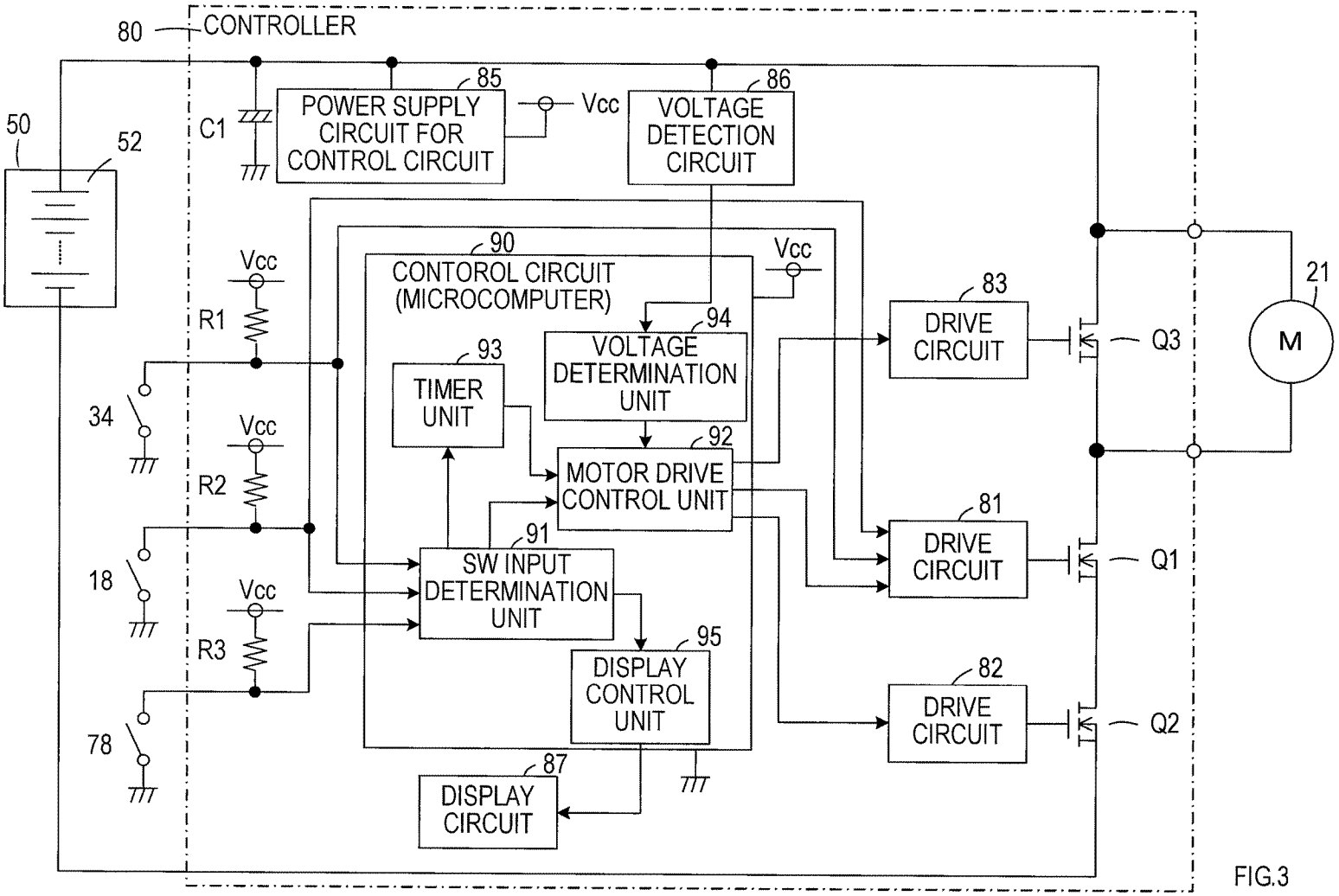
FIG. 3 is a block diagram showing a configuration of a controller of the fastener driving tool in one embodiment.

The controller 80, as shown in FIG. 3, is provided with two drive switching elements Q1, Q2 provided in a power supply path extending from the motor 21 to a negative electrode of the battery 52, among power supply paths from the battery 52 inside the battery pack 50 to the motor 21.

The drive switching elements Q1, Q2, in the present embodiment, are composed of n-channel MOSFETs. Therefore, the drive switching elements Q1, Q2 are turned on when a drive signal of high level is input to a gate, and form a power supply path to the motor 21.

The controller 80 is also provided with a brake switching element Q3 connected in parallel to the motor 21. The brake switching element Q3 passes a brake current by an electromotive force generated accompanying the rotation of the motor 21 after the power supply to the motor 21 is stopped, thereby to generate a braking torque (hereinafter, referred to as a brake force) in the motor 21.

The brake switching element Q3, similar to the drive switching elements Q1, Q2, is composed of an n-channel MOSFET, and is turned on when a drive signal of high level is input to the gate, to transmit the brake current to the motor 21.

The controller 80 comprises: drive circuits 81, 82, 83 for turning on/off the switching elements Q1, Q2, Q3; a control circuit 90 that controls the motor 21 via the drive circuits 81, 82, 83; and a power supply circuit 85 for the control circuit 90.

To a power supply line to which the power supply voltage Vcc generated by the power supply circuit 85 is supplied, one ends of the trigger switch 34, the contact arm switch 18, and top dead center detection switch 78 described above are connected via pull-up resistors R1, R2, R3, respectively. The other ends of these switches 34, 18, 78 are grounded to a ground line as a negative electrode of the power source line.

Therefore, the detection signal from each switch 34, 18, 78 will be taken into the controller 80 as low level when the switch 34, 18, 78 is on, and as high level when the switch 34, 18, 78 is off.

A capacitor C1 for absorbing fluctuation of a battery voltage caused by the drive of the motor 21, and a voltage detection circuit 86 as a battery voltage detection unit that detects a battery voltage, are connected to the power supply path extending from a positive electrode of the battery 52 to the motor 21.

A detection signal from this voltage detection circuit 86 and detection signals from the respective switches 34, 18, 78 are input to the control circuit 90.

The control circuit 90 is mainly composed of a well-known microcomputer having a CPU, and semiconductor memories such as a ROM, a RAM, a flash memory, and the like. The control circuit 90 functions as a switch input determination unit 91, a motor drive control unit 92, a timer unit 93, a voltage determination unit 94, and a display control unit 95.

These functions are implemented by the CPU executing a program stored in the semiconductor memory that is a tangible, non-transitory recording medium. Execution of the program implements a control method corresponding to the program.

A means for implementing the above functions in the control circuit 90 is not limited to software. Part or all of the functions can be implemented using hardware combined with a logic circuit, an analog circuit, or the like.

The switch input determination unit 91 determines the on/off states of the respective switches 34, 18, 78. The motor drive control unit 92 controls the motor 21 in accordance with the on/off state of each switch 34, 18, 78.

Figure 4:
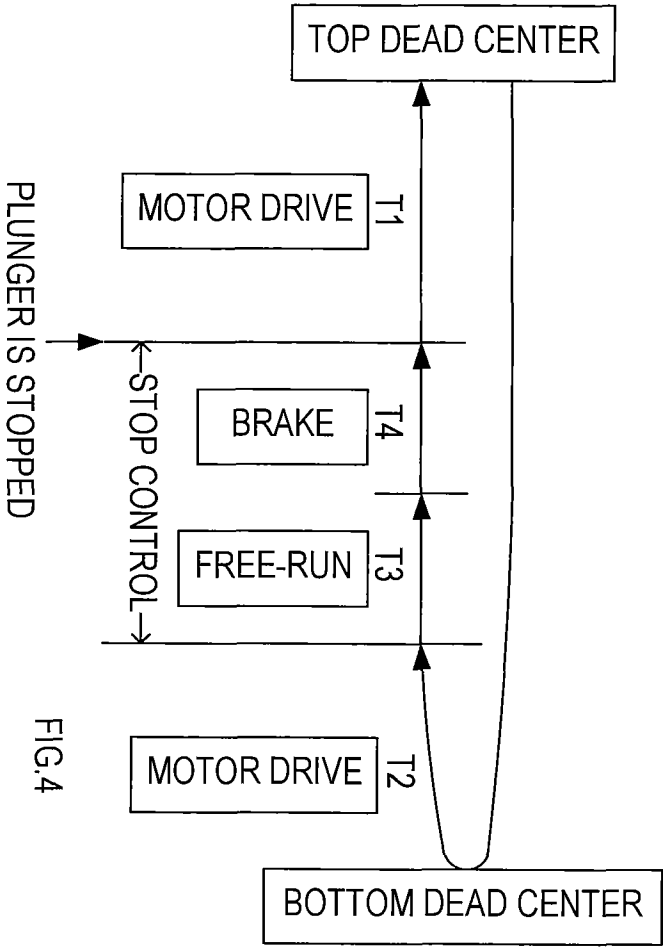
FIG. 4 is an explanatory diagram showing a relationship between a motor control and a plunger position in one embodiment.

As shown in FIG. 4, control of the motor 21 by the motor drive control unit 92 is performed in an initial state, that is, when each of the drive and brake switching elements Q1, Q2, Q3 is in the off state and the plunger 66 is stopped at a predetermined position.

The motor drive control unit 92, when the trigger switch 34 is turned on in the initial state, turns on the drive switching element Q2 via the drive circuit 82, and verifies whether at least one of the drive switching elements Q1, Q2 is defective from changes in a voltage value of a drain.

When it is detected that at least one of the drive switching elements Q1, Q2 is defective, the motor drive control unit 92 prohibits the drive of the motor 21. In this case, the motor drive control unit 92 may direct the display circuit 87 to indicate that the drive switching element is defective.

Furthermore, the motor drive control unit 92, when the trigger switch 34 and the contact arm switch 18 are both turned on in the initial state, determines that a driving command has been input, and turn on the drive switching elements Q1, Q2 through the drive circuits 81, 82, to start the drive of the motor 21.

The drive of the motor 21 continues until time T1 elapses, during which the plunger 66 reaches top dead center, to release the impact spring 64, and then time T2 elapses during which the plunger 66 moves to bottom dead center to complete driving and the plunger 66 returns toward top dead center.

When both the time T1, T2 have elapsed, the motor drive control unit 92 turns off the drive switching elements Q1, Q2 to stop the drive of the motor 21.

In this state, the motor 21 is in a free-run state, and the plunger 66 moves further toward top dead center. Thus, the motor drive control unit 92, after a predetermined free-run time T3 has elapsed, turns on the brake switching element Q3 to generate a brake force to the motor 21.

As a result, the plunger 66 stops, and the stop position is the next position to start the drive of the motor. When the stop position of the plunger 66 changes, time after the drive command is input until the driving target 3 is driven into the substrate 2 changes. Thereby, the user is given a sense of discomfort.

Therefore, the motor drive control unit 92 controls the motor drive time T2 from when top dead center detection switch 78 is turned on/off until the drive of the motor 21 is stopped, the free-run time T3, and the brake control time T4, thereby to control the stop position of the plunger 66 after driving.

Then, when the brake control time T4 elapses, the motor drive control unit 92 turns off the brake switching element Q3 to turn on the drive switching element Q2 again.

The timer unit 93 counts a control time of the motor 21 by the motor drive control unit 92, that is, the motor drive time T1, T2, the free-run time T3, and the brake time T4.

The voltage determination unit 94 detects the battery voltage based on the detection signal from the voltage detection circuit 86 to reflect the detected battery voltage on the control of the motor 21.

The display controller 95 directs the display circuit 87 to display an operating state of the fastener driving tool 1 based on the determination result by the switch input determination unit 91.

Next, a motor drive control process will be described that is repeatedly performed as one of the main routines in the microcomputer of the control circuit 90, in order to implement the function as the motor drive control unit 92.

Figure 5A:
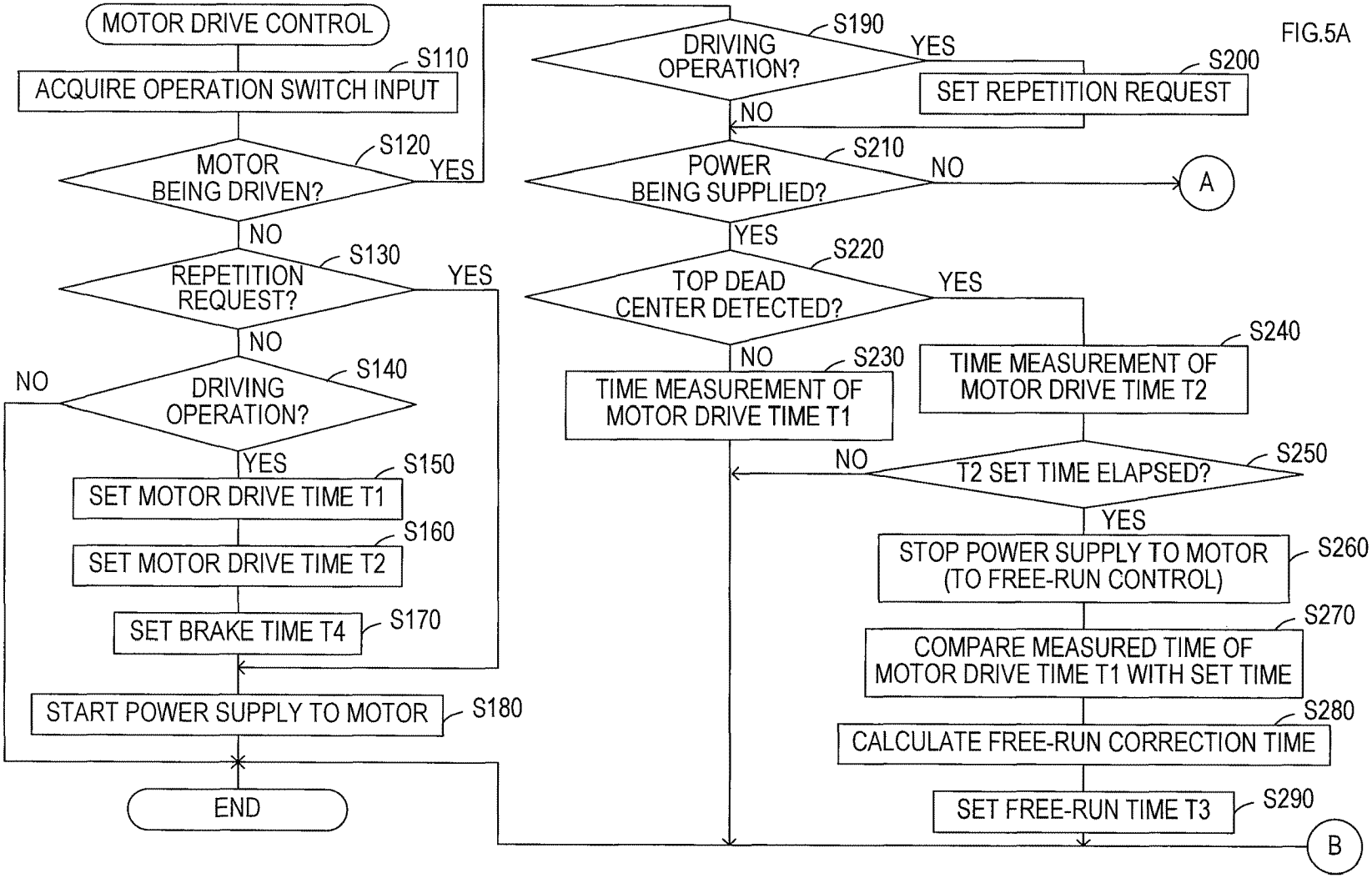
FIG. 5A is a flowchart showing a motor drive control executed by a control circuit in one embodiment.

As shown in FIG. 5A, in this motor drive control process, first in S110, an operation switch input acquisition process is performed in which states of the trigger switch 34 that is an operation switch of the fastener driving tool 1 and the contact arm switch 18 are determined.

In S120, it is determined whether the motor 21 is being driven. If the motor 21 is not being driven, the process proceeds to S130. If the motor 21 is being driven, the process proceeds to S190.

In S120, it is determined that the motor 21 is being driven if the motor is in one cycle period of driving operation from when the motor 21 is started being driven by power supply to the motor 21 until the brake control is ended (T1+T2+T3+T4).

In S130, it is determined whether a repetitive request (flag in detail) to repeatedly drive the driving target 3 is set. If the repetitive request is set, the process proceeds to S180. If the repetitive request is not set, the process proceeds to S140.

In S140, it is determined, from the acquired states of the trigger switch 34 and the contact arm switch 18 in S110, whether there is a requested driving operation to turn both of these two switches 34, 18 into the on state, i.e., whether a driving command is input.

When it is determined in S140 that there is no requested driving operation, there is no necessity to drive the motor 21 and the motor drive control process is temporarily ended. When it is determined in S140 that there is a requested driving operation, the process proceeds to S150.

In S150, by using the battery voltage detected by the voltage detection circuit 86 and the map shown in FIG. 6, an allowable range of the motor drive time T1 after when the motor 21 is started being driven until the plunger 66 reaches top dead center to release the impact spring 64 (that is, prior to the start of the driving) is set as a set time.

The map shown in FIG. 6 sets, in accordance with the battery voltage, the allowable range of the motor drive time T1, the motor drive time T2, the free-run time T3, and the brake time T4, which are stored in the non-volatile memory (ROM, flash memory, etc.) inside the control circuit 90.

In particular, in the present embodiment, in order to reduce change in the stop position of the plunger 66 before the motor is started being driven, the free-run time T3 is adapted to be set based on a deviation from the allowable range of the actually measured motor drive time T1.

Specifically, as parameters for setting the free-run time T3, a reference time (30 ms in the figure), and a correction amount representing a ratio by which the deviation (time difference) from the allowable range of the measured motor drive time T1 is multiplied, are provided.

Further, in the map shown in FIG. 6, each correction amount of the allowable range of the motor drive time T1, the motor drive time T2, and the free-run time T3 is set such that, as the battery voltage is lower, the time is longer. The brake time T4 is set to be a predetermined time.

This is because, as the battery voltage is lower, a driving torque generated during the power supply to the motor 21 is reduced and time required for winding up the impact spring 64 to move the plunger 66 is increased. Setting each of the above time in this way can reduce changes in the stop position after elapse of one cycle of driving operation.

In S160, using the battery voltage and the map shown in FIG. 6, the motor drive time T2 after the driving is started until power supply to the motor 21 is stopped is set. In subsequent S170, using the battery voltage and the map shown in FIG. 6, the brake time T4 is set.

In S180, the drive switching elements Q1, Q2 are turned on via the drive circuits 81, 82, to start power supply to the motor 21 (in other words, drive of the motor 21). The motor drive control process is temporarily ended.

In FIG. 3, to the drive circuit 81, not only a control signal for turning on/off the drive switching element Q1 is input from the motor drive control unit 92, but the detection signals from the trigger switch 34 and the contact arm switch 18 are also input.

This is because, when at least one of the trigger switch 34 and the contact arm switch 18 is turned off, regardless of the control signal from the motor drive control unit 92, the switching element Q1 is forced into the off state by the drive circuit 81.

With this configuration, for example, if the control signal to turn on the drive switching elements Q1, Q2 is output from the control circuit 90, due to malfunction of the control circuit 90, power supply to the motor 21 can be prohibited so that the motor 21 is not driven.

In S190, similar to S140, it is determined whether there is a requested driving operation based on the states of the trigger switch 34 and the contact arm switch 18 acquired in S110.

When it is determined in S190 that there is a requested driving operation, it is determined that a repetitive request for repetitively driving the driving target 3 has been entered in this requested driving operation, since the motor 21 is currently is being driven. The process proceeds to S200. In S200, a repetitive request (flag in detail) is set, and the process proceeds to S210. If it is determined in S190 that there is no requested driving operation, the process proceeds to S210.

In S210, it is determined whether the drive switching elements Q1, Q2 are currently turned on, and power is being supplied to the motor 21.

If power is currently being supplied to the motor 21, the process proceeds to S220. It is then determined whether top dead center detection switch 78 is turned on/off, that is, the driving by the impact spring 64 has been started after power supply to the motor 21 is started.

When it is determined in S220 that the driving by the impact spring 64 is not started after the power supply to the motor 21 is started, the process proceeds to S230. Time measurement is performed of the elapsed time after the power supply to the motor 21 is started in S180, that is, the motor drive time T1. After the time measurement, the motor drive control process is temporarily ended.

The time measurements executed in S230 and in S240, S310, and S340 to be described later are performed, for example, by counting up a timer counter. The function as the timer unit 93 is implemented by the procedures in S230, S240, S310, and S340.

When it is determined in S220 that top dead center detection switch 78 has been turned on/off, and the driving by the impact spring 64 has been started after the power supply to the motor 21 is started, the process proceeds to S240. Time measurement is performed of the motor drive time T2 after the driving is started.

In subsequent S250, it is determined whether the measured motor drive time T2 is consistent with the motor drive time T2 set in S160, that is, whether the motor drive time T2 set in S160 has elapsed after the driving is started.

If it is determined in S250 that the motor drive time T2 set in S160 has elapsed after the driving is started, the process proceeds to S260. Otherwise, the motor drive control process is temporarily terminated.

In S260, since the motor drive time T2 which is set in S160 has elapsed after the driving is started, the switching elements Q1, Q2 are turned off through the drive circuits 81 and 82, and the power supply to the motor 21 is cut off. As a result, the motor 21 enters the free-run state, and the plunger 66 moves toward top dead center by inertia.

In S270, the motor drive time T1 measured in S230 is compared with the allowable range of the motor drive time T1 set in S150. If the measured motor drive time T1 is out of the allowable range, a time difference is calculated that is a deviation amount from the acceptable range. In S270, if the measured motor drive time T1 is within the allowable range set in S150, the time difference is set as zero.

In subsequent S280, a correction time of the free-run time T3 is calculated by multiplying the time difference calculated in S270 by the correction amount (ratio) acquired from the map shown in FIG. 6. The process proceeds to S290.

In S290, the free-run time T3 to be employed in the control is set by correcting the reference time of the free-run time T3 using the correction time calculated in S280. The motor drive control process is temporarily ended.

In S290, in the initial driving operation from when battery power is not supplied to the controller 80 until the battery power is supplied and the controller 80 becomes operational, the reference time of the free-run time T3 acquired from the map shown in FIG. 6 is used. Then, in the subsequent driving operation, the free-run time T3 set in previous S290 is used as the reference time of the free-run time T3.

Further, in S290, when the measured motor drive time T1 is shorter than a lower limit of the allowable range acquired from the map shown in FIG. 6, the correction time is subtracted from the reference time of the free-run time T3 since the stop position of the plunger 66 is too close to top dead center.

In other words, in this case, the free-run time T3 is set such that "free-run time T3=reference time−time difference×correction amount". As a result, the stop position of the plunger 66 when the next driving operation is started is controlled to an appropriate position farther from top dead center than the current stop position.

Conversely, if the measured motor drive time T1 is longer than an upper limit of the allowable range acquired from the map shown in FIG. 6, the correction time is added to the reference time of the free-run time T3 since the stop position of the plunger 66 is too far from top dead center.

In other words, in this case, the free-run time T3 is set such that "free-run time T3=reference time+time difference×correction amount". As a result, the stop position of the plunger 66 when the next driving operation is started is controlled to an appropriate position closer to top dead center than the current stop position.

Figure 5B:
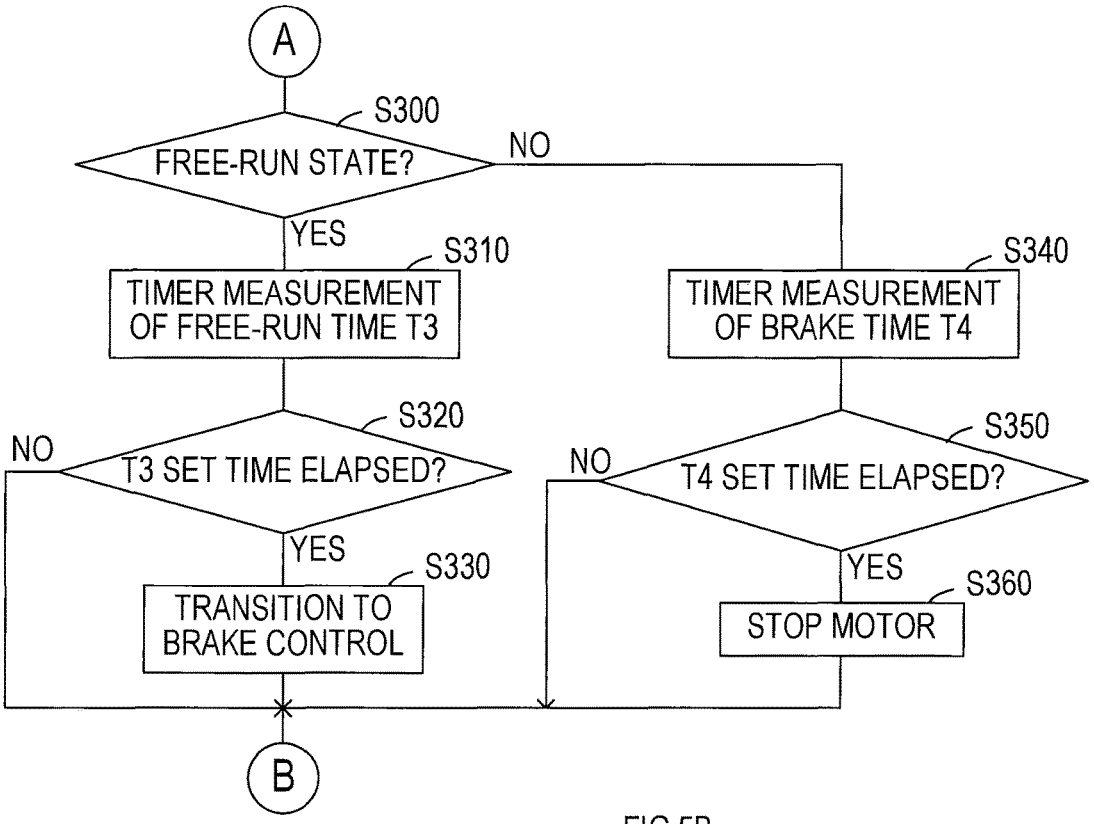
FIG. 5B is a flowchart showing the motor drive control executed by the control circuit in one embodiment.

In S210, when it is determined that the power is not being supplied to the motor 21, the process proceeds to S300 shown in FIG. 5B. It is then determined whether the drive switching elements Q1, Q2 and the brake switching element Q3 are turned off and the motor 21 is in the free-run state.

As shown in FIG. 5B, if the motor 21 is in the free-run state, the process proceeds to S310. Time measurement of the free-run time T3 is performed. The process proceeds to S320.

In S320, it is determined whether the free-run time T3 acquired by the time measurement is consistent to the free-run time T3 set in S290, in other words, whether the free-run time T3 set in S290 has elapsed since the power supply to the motor 21 is stopped in S260.

In S320, when it is determined that the free-run time T3 set in S290 has elapsed, the process proceeds to S330. Otherwise, the motor drive control process is temporarily terminated.

In S330, since the free-run time T3 set in S290 has elapsed after the power supply to the motor 21 is cut off, the brake switching element Q3 is turned on via the drive circuit 83 to start brake control, and the motor drive control process is temporarily ended.

In S300, when it is determined that the motor 21 is not in the free-run state, that is, if the brake control is being performed, the process proceeds to S340, and time measurement of the brake time T4 is performed. The process proceeds to S350.

In S350, it is determined whether the brake time T4 acquired by the time measurement is consistent with the brake time T4 set in S170, in other words, whether the brake time T4 set in S170 has elapsed since the brake control is started in S330.

In S350, if it is determined that the brake time T4 set in S330 has not elapsed, the motor drive control process is temporarily terminated.

Conversely, if it is determined in S350 that the brake time T4 set in S330 has elapsed, the brake switching element Q3 is tuned off in S360 to end the brake control and stop the motor 21. With this process of S360, one cycle of driving operation is completed.

Since the one-way clutch 29 is provided to the reduction mechanism 23, even if the brake switching element Q3 is turned off in S360, the motor 21 is not reversely rotated by the biasing force of the impact spring 64 and the plunger 66 does not move toward bottom dead center. That is, the plunger 66, when one cycle of driving operation is completed, is positioned at a position at that time.

Figure 7:
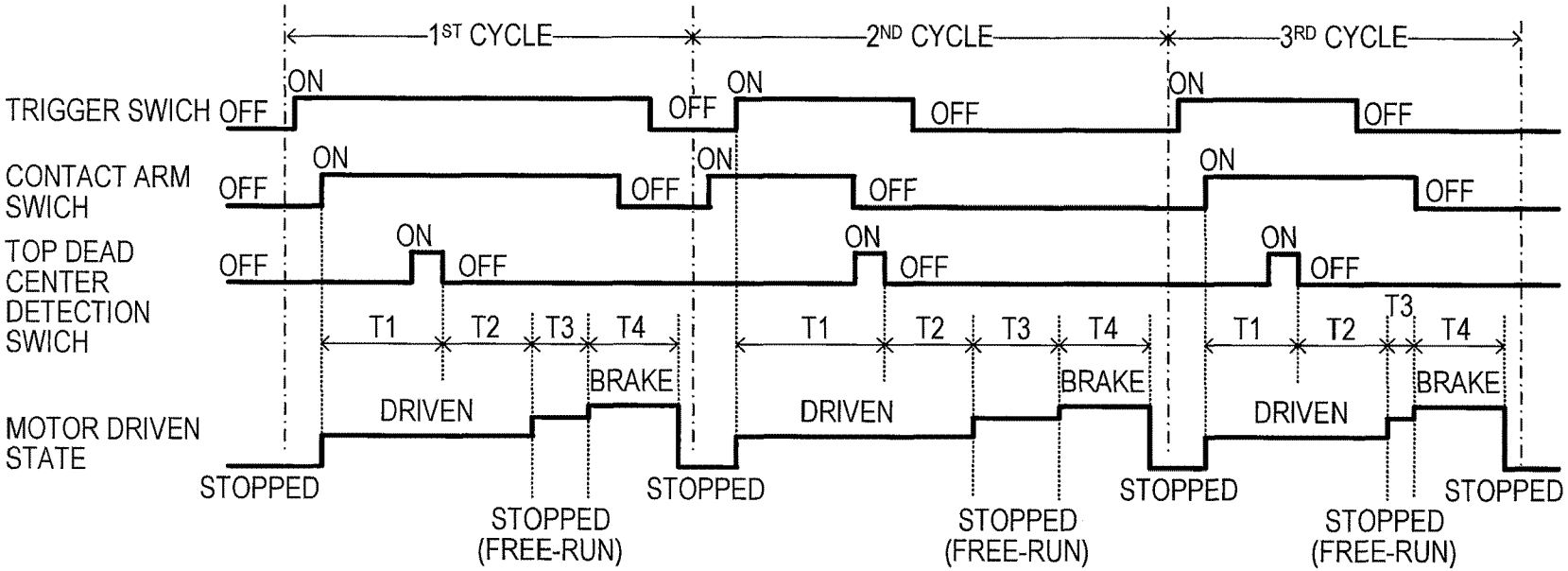
FIG. 7 is a time chart showing control results by the motor drive control of FIGS. 5A and 5B in one embodiment.

As described above, in the fastener driving tool 1 of the present embodiment, when the trigger switch 34 and the contact arm switch 18 are both turned on, as shown in FIG. 7, the motor 21 is started being driven.

Further, when top dead center detection switch 78 is turned on/off and the driving is started after the motor 21 is started being driven, the motor 21 is continued to be driven for the motor drive time T2, and then the motor 21 is rotated in the free-run state during the free-run time T3.

When the free-run time T3 has elapsed, the brake control for generating a brake force to the motor 21 is performed until the brake time T4 has elapsed. Then, the motor 21 is stopped.

Further, in this embodiment, the motor drive time T1 until top dead center detection switch 78 is turned on/off and the driving is started after the motor 21 is started driven is measured.

Then, if the measured motor drive time T1 is out of the allowable range as the set time, the free-run time T3 after the drive of the motor 21 is stopped is corrected since the stop position of the plunger 66 before the motor is started driven deviates from the proper position.

For example, as in the second cycle shown in FIG. 7, when the motor drive time T1 is longer than the allowable range, the free-run time T3 is increased to correct the next stop position to top dead center side, since the stop position of the plunger 66 is on bottom dead center side as compared to a proper position.

Further, as in the third cycle shown in FIG. 7, when the motor drive time T1 is shorter than the allowable range, the free-run time T3 is shortened to correct the next stop position to the lower dead center side, since the stop position of the plunger 66 is on top dead center side as compared to a proper position.

As a result, according to the fastener driving tool 1 of the present embodiment, the stop position of the plunger 66 when the motor is started driven is able to be automatically corrected to a proper position. Change of time since the user enters a driving command until the driving target 3 is driven can be reduced.

Accordingly, a sense of discomfort to the user due to the change of time can be reduced. Usability of the fastener driving tool 1 can be improved.

The stop position of the plunger 66 after completion of the driving operation is affected by the battery voltage. In the present embodiment, the allowable range of the motor drive time T1 (set time), the motor drive time T2, and the free-run time T3 are set according to the battery voltage. Specifically, as the battery voltage is higher, the respective time is set to be longer.

Therefore, according to the fastener driving tool 1 of the present embodiment, change of the stop position of the plunger 66 before the motor 21 is started driven due to change (drop) of the battery voltage can be reduced.

Each of the time used for the stop position control of the plunger 66 is set using the battery voltage detected before power supply to the motor 21 is started in S180. Therefore, even if the battery voltage fluctuates along with the rotation of the motor 21, each of the times can be set properly without being affected by the fluctuation of the battery voltage.

Furthermore, in the present embodiment, power supply to the motor 21 is cut off and the free-run time T3 is corrected before the brake control is started. Thereby, the stop position of the plunger 66 is controlled.

Therefore, it is not necessary to control the power supplying current to the motor 21 for the stop position control of the plunger 66. The stop position control can be easily performed.

In the present embodiment, when the driving command is input while the motor is driven, and the driving of the driving target 3 must be repetitively performed, various time settings in S150 to S170 in each cycle of driving operation are prohibited.

This is because, when the driving operation is repeatedly performed in a short time, the battery voltage may drop temporarily and fluctuate. That is, in this case, when the procedures of S150 to S170 are executed in each cycle of driving operation, various time set in S150 to S170 are changed, whereby the stop position of the plunger 66 may be changed.

Therefore, in the present embodiment, when there is a repetitive request for repetitively performing the driving, time settings in S150 to S170 are prohibited. Thereby, change of the stop position of the plunger 66 in each cycle of driving operation is reduced.

In this embodiment, when an interval between each cycle of driving operation is very short due to the repetitive request for driving, the time settings in S150 to S170 are prohibited. However, the interval between each cycle of driving operation may be measured.

That is, for example, when it is determined in S140 that there is a driving operation, the elapsed time from the previous driving operation is measured. When the elapsed time is shorter than a preset set interval, the time settings in S150 to S170 are prohibited.

Even in this way, change of the stop position of the plunger 66 due to fluctuation of the battery voltage can be reduced.

[First Modification]

In the above embodiment, the free-run time T3 is controlled in accordance with the motor drive time T1 after the motor 21 is started being driven until top dead center detection switch 78 is turned on/off, for the stop position control of the plunger 66. Alternatively, the brake time T4 may be controlled.

In the first modification, the motor drive control process in which the brake time T4 is controlled in response to the motor drive time T1, and a map used in the control, will be described.

In this modification, a map shown in FIG. 9 will be used.

This map is configured to set the allowable range of the motor drive time T1, the motor drive time T2, the free-run time T3, the brake time T4, and the brake force, according to the battery voltage.

The brake force is defined by a drive duty ratio of the brake switching element Q3 when the brake switching element Q3 is turned on to transmit a brake current to the motor 21. The brake switching element Q3 is PWM (Pulse Width Modulation) controlled by the drive duty ratio.

In the map shown in FIG. 9, the brake force is fixed to a constant value (100%), and the free-run time T3 is also fixed to a constant value (30 ms).

Further, the brake time T4 is defined by the reference time set according to the battery voltage and a correction amount representing a ratio by which the deviation (time difference) from the allowable range of the measured motor drive time T1 is multiplied, in order to suppress change of the stop position of the plunger 66 before the motor is started being driven.

It is necessary to increase the brake time T4 as the battery voltage is higher (in other words, as the driving torque generated upon power supply to the motor 21 is larger).

Therefore, both the reference time of the brake time T4 and the correction amount are set such that the brake time T4 is longer as the battery voltage is higher.

This map is used in the motor drive control process, but the basic procedures are the same as those shown in FIGS. 5A and 5B. Therefore, in the following description, the motor drive control process of the first modification will be described, focusing on points that differ from FIGS. 5A and 5B. The same procedures as those in FIGS. 5A and 5B will not be repeated.

Figure 8:
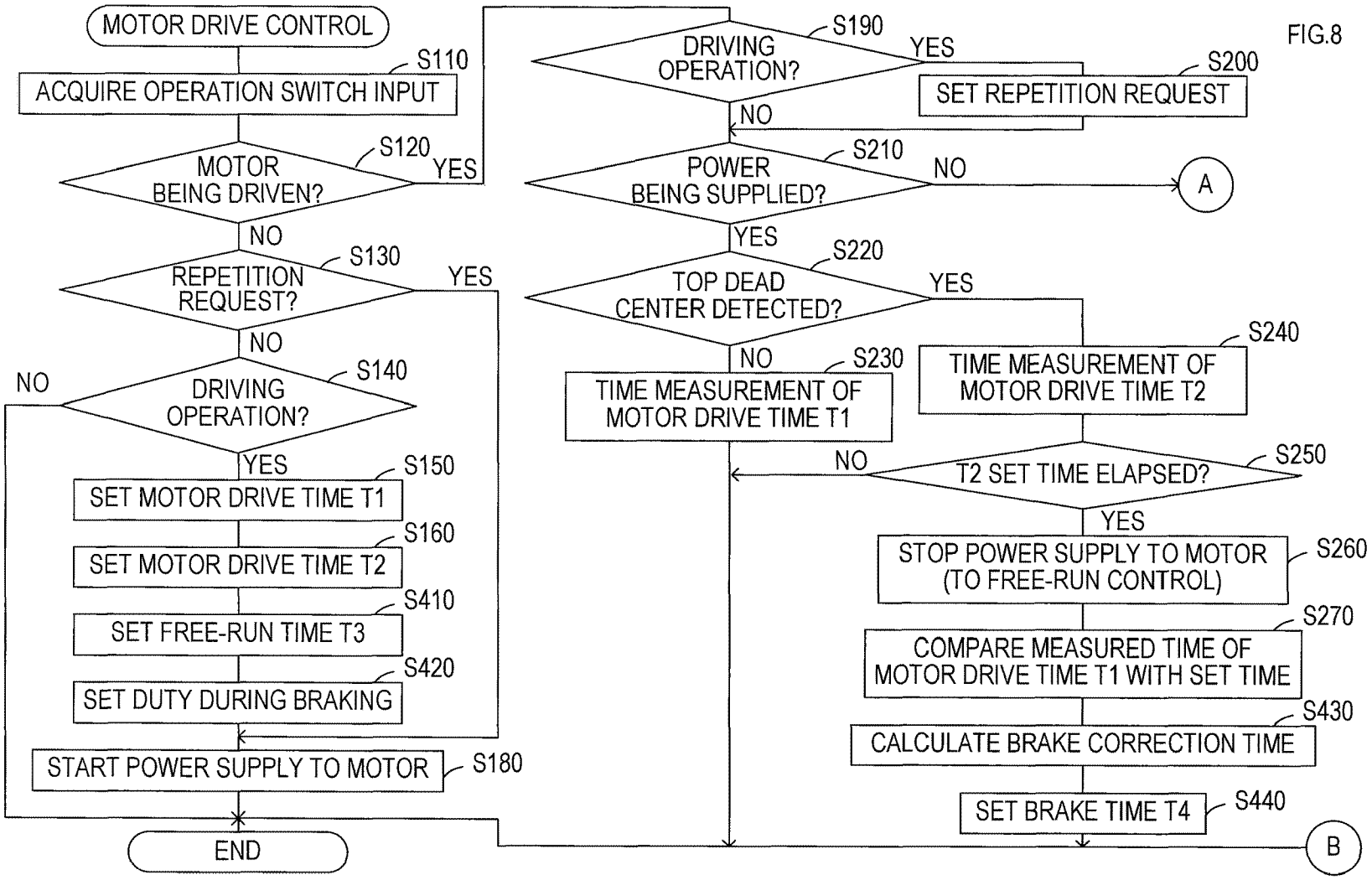
FIG. 8 is a flowchart showing part of a motor drive control of a first modification.

As shown in FIG. 8, in this modification, after the motor drive time T2 is set in S160, the free-run time T3 and the drive duty ratio of the brake switching element Q3 during braking are set in S410 and S420, using the battery voltage and the map shown in FIG. 9.

Further, power supply to the motor 21 is stopped in S260. When the deviation amount (time difference) from the set range of the motor drive time T1 is calculated in S270, the process proceeds to S430. The correction time of the brake time T4 is calculated in the same manner as in S280.

Then, in S440, the reference time of the brake time T4 is corrected using the correction time calculated in S430. Thereby, the brake time T4 used in the control is set. The motor drive control process is temporarily ended.

In S440, the reference time of the brake time T4 acquired from the map shown in FIG. 9 is used in the initial driving operation from when battery power is not supplied to the controller 80 until the battery power is supplied and the controller 80 becomes operational. In the subsequent driving operation, the brake time T4 set in previous S440 is used as the reference time of the brake time T4.

In S440, when the measured motor drive time T1 is shorter than a lower limit of an allowable range acquired from the map shown in FIG. 9, the correction time is added to the reference time of the brake time T4, since the stop position of the plunger 66 is too close to top dead center.

This correction increases the brake time T4. Thus, the motor 21 is largely decelerated by the brake control. The next stop position of the plunger 66 is controlled to a proper position which is farther from top dead center than the current stop position.

In S440, if the measured motor drive time T1 is longer than an upper limit of the allowable range acquired from the map shown in FIG. 9, the correction time is subtracted from the reference time of the brake time T4, since the stop position of the plunger 66 is too far from top dead center.

This correction shortens the brake time T4. Thus, deceleration of the motor 21 by the brake control is reduced. The next stop position of the plunger 66 is controlled to a proper position closer to top dead center than the current stop position.

The drive duty ratio set in S420 is used to PWM control the brake switching element Q3 upon execution of the brake control initiated in S330.

Fluctuation of the stop position of the plunger 66 can be reduced even if the brake time T4 is controlled in accordance with the deviation from the allowable range of the motor drive time T1 after the motor 21 is started being driven until top dead center detection switch 78 is turned on/off, as in this modification.

[Second Modification]

In the above embodiment and the first modification, it is described that, in order to control the stop position of the plunger 66, the control time in the stop control of the motor 21, that is, the free-run time T3 or the brake time T4 is corrected. Alternatively, the brake force may be corrected.

In the second modification, the motor drive control process in which the brake force is controlled according to the motor drive time T1, and a map used in the control, will be described.

In this modification, a map shown in FIG. 11 is used.

This map is configured to set the allowable range of the motor drive time T1, the motor drive time T2, and the brake force, according to the battery voltage. A constant value is set to each of the free-run time T3 and the brake time T4.

Similar to the first modification, the brake force is a drive duty ratio of the brake switching element Q3 when the brake switching element Q3 is turned on to transmit a brake current to the motor 21. In this map, the brake force is defined by the reference value and the correction amount.

The correction amount defined in this map is a correction amount per unit time (per 1 ms in the figure) of the deviation (time difference) from the allowable range of the measured motor drive time T1. Therefore, when the drive duty ratio is actually corrected, the deviation (time difference) from the allowable range of the measured motor drive time T1 is multiplied by the correction amount to calculate a revised correction amount.

Further, in order to make the stop position of the plunger 66 constant, it is necessary to increase the brake force generated upon the brake control as the battery voltage is higher (in other words, as the driving torque generated upon power supply to the motor 21 is larger).

Therefore, both the reference value of the brake force and the correction amount defined by the map are set to be larger, as the battery voltage is higher.

This map is used in the motor drive control process, but the basic procedures are the same as those shown in FIGS. 5A and 5B and FIG. 8. Therefore, in the following description, the motor drive control process of the second modification will be described, focusing on points that differ from FIGS. 5A and 5B and FIG. 8. The same procedures as those in FIGS. 5A and 5B and FIG. 8 will not be repeated.

Figure 10:
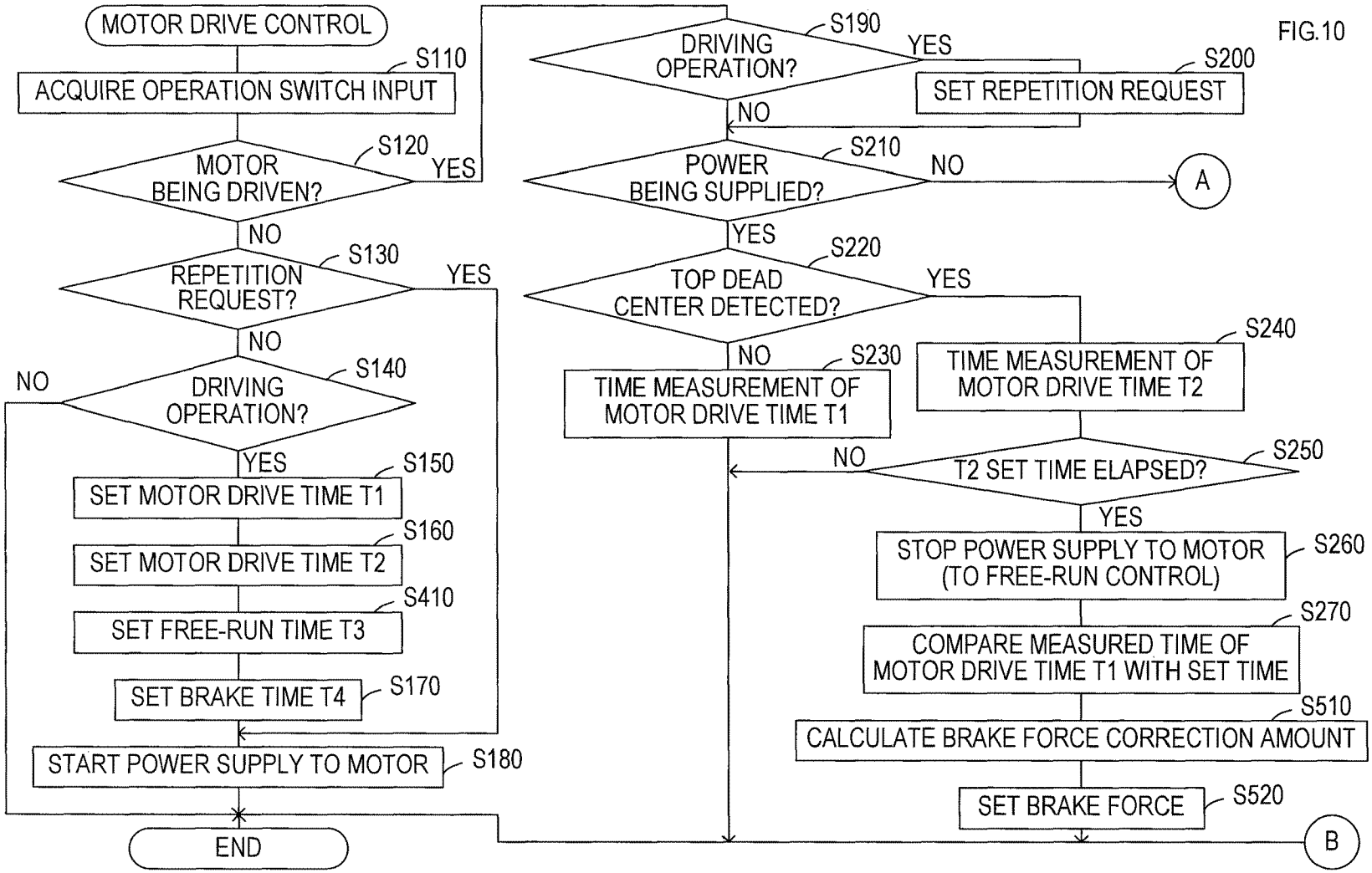
FIG. 10 is a flowchart showing part of a motor drive control of a second modification.

As shown in FIG. 10, in this modification, after the motor drive time T2 is set in S160, the free-run time T3 and the brake time T4 are set in S410 and S170, using the battery voltage and the map shown in FIG. 11.

Power supply to the motor 21 is stopped in S260. When the deviation amount (time difference) from the set range of the motor drive time T1 is calculated in S270, the process moves to S510. Using the battery voltage and the map shown in FIG. 11, the correction amount of the brake force is calculated. The procedure for calculating the correction amount is as described above.

When the correction amount of the brake force is calculated in S510, the process proceeds to S520. The reference value of the brake force is corrected by the correction amount calculated in S510, and the brake force to be used for control is set.

In S520, the reference value of the brake force acquired from the map shown in FIG. 11 is used in the initial driving operation from when battery power is not supplied to the controller 80 until the battery power is supplied and the controller 80 becomes operational. In the subsequent driving operation, the brake force set in previous S520 is used as the reference value of the brake force.

In S520, when the measured motor drive time T1 is shorter than a lower limit of the allowable range acquired from the map shown in FIG. 11, the correction amount is added to the reference value of the brake force, since the stop position of the plunger 66 is too close to top dead center.

This correction increases the brake force generated by the brake control. Thus, the motor 21 will be largely decelerated. The next stop position of the plunger 66 is controlled to a proper position farther from top dead center than the current stop position.

In S520, if the measured motor drive time T1 is longer than an upper limit of the allowable range acquired from the map shown in FIG. 11, the correction amount is subtracted from the reference value of the brake force, since the stop position of the plunger 66 is too far from top dead center.

This correction reduces the brake force generated by the brake control. Thus, deceleration of the motor 21 is reduced, and the next stop position of the plunger 66 is controlled to a proper position closer to top dead center than the current stop position.

The brake force (duty ratio) set in S520 is used to PWM control the brake switching element Q3 upon execution of the brake control initiated in S330.

Fluctuation of the stop position of the plunger 66 can be reduced even if the brake force is controlled in accordance with the deviation from the allowable range of the motor drive time T1 after the motor 21 is started being driven until top dead center detection switch 78 is turned on/off, as in this modification.

[Other Modifications]

The embodiments and modifications of the present disclosure have been described in the above. The present disclosure is not limited to the above embodiments and modifications, and a variety of modes can be taken.

For example, in the above embodiment and modifications, in order to set the correction amount of the free-run time T3, the brake time T4, or the brake force, it is described that the motor drive time T1 after the motor 21 is started being driven until top dead center detection switch 78 is turned on/off is detected.

However, the motor drive time used to set the correction amount may not be the time until top dead center detection switch 78 is turned on/off, but may be time until top dead center detection switch 78 is turned on.

Further, the motor drive time used to correct the free-run time T3, the brake time T4, and the brake force may be any time which changes depending on the stop position of the plunger 66 when the motor is started being driven, and from which time the stop position of the plunger 66 can be estimated.

Therefore, the motor drive time for setting the correction amount may be measured at a predetermined position after the motor 21 is driven until the plunger 66 reaches top dead center. Also, the motor drive time for setting the correction amount may be measured at a predetermined position after driving is started by the plunger 66.

In this case, it is necessary to detect the position of the plunger 66 at a position different from top dead center. For the detection, a non-contact sensor, for example, such as a magnetic sensor, that can detect the position of the plunger 66 in a non-contact manner may be used.

Further, while the motor is driven 21, the position of the plunger 66 corresponds to the rotation amount after the motor 21 is driven, until the plunger 66 reaches top dead center. Therefore, a rotation sensor for detecting an rotation amount of the motor 21, the output shaft 27, or the spur gear 72 may be provided to the motor 21, the deceleration mechanism 23 or the drive mechanism 70, and time until the detected rotation amount reaches a predetermined amount may be measured as the motor drive time for setting the correction amount.

In the above embodiment and modifications, it is described that, when the motor drive time T1 is out of the allowable range, one of the free-run time T3, the brake time T4 and the brake force is corrected based on the deviation amount (time difference).

In contrast, when the motor drive time T1 is out of the allowable range, two or all of these three parameters may be corrected based on the deviation amount (time difference).

A plurality of functions of one component of the above-described embodiment and modifications may be implemented by a plurality of components, or one function of a single component may be implemented by a plurality of components. Further, a plurality of functions of a plurality of components may be implemented by a single component, or one function implemented by a plurality of components may be implemented by a single component. Part of the configuration of the above embodiment and modifications may be omitted. Further, at least part of the configuration of the above embodiment and modifications may be added or substituted to the configuration of the other of the above embodiment and modifications. All aspects included in the technical idea specified by only the language as set forth in the appended claims are embodiments of the present disclosure.

What is claimed is:

1. A fastener driving tool comprising:

a plunger that configured to move in a driving direction of a driving target;

an impact spring that biases the plunger in the driving direction;

a motor;

a drive mechanism coupled to the motor and configured to move the plunger, by rotation of the motor, in a direction opposite to the driving direction, and configured to disengage the plunger when the plunger reaches top dead center;

a motor drive control unit that starts power supply to the motor in accordance with a received driving command, and then cuts off the power supply to the motor when the movement of the plunger is performed and a motor drive time required for the plunger to move from bottom dead center to top dead center side has elapsed;

a position detection unit that detects that the plunger has reached a predetermined position during the power supply to the motor by the motor drive control unit; and a timer unit that measures time after the power supply to the motor is started by the motor drive control unit until the position detection unit detects that the plunger has reached the predetermined position, the motor drive control unit being further configured to execute a stop control for stopping the motor at the predetermined stop position after the power supply to the motor is cut off, based on the time measured by the timer unit.

2. The fastener driving tool according to claim 1, wherein the motor drive control unit is configured to execute a free-run control for rotating the motor by inertia and a brake control for generating a brake force to the motor, after cutting off the power supply to the motor, thereby implementing the stop control.

3. The fastener driving tool according to claim 2, wherein, in the stop control, the motor drive control unit is configured to control at least one of execution time of the free-run control and execution time of the brake control based on the time measured by the timer unit.

4. The fastener driving tool according to claim 3, wherein, in the stop control, the motor drive control unit is configured to control the execution time of the free-run control so that the execution time of the free-run control is shorter when the measured time is shorter than a preset set time, and the execution time of the free-run control is longer when the measured time is longer than the preset set time.

5. The fastener driving tool according to claim 3, wherein, in the stop control, the motor drive control unit is configured to control the execution time of the brake control so that the execution time of the brake control becomes longer when the measurement time is shorter than the preset set time, and the execution time of the brake control becomes shorter when the measurement time is longer than the preset set time.

6. The fastener driving tool according to claim 2, wherein, in the stop control, the motor drive control unit is configured to control the brake force generated by the brake control based on the time measured by the timer unit.

7. The fastener driving tool according to claim 6, wherein, in the stop control, the motor drive control unit is configured to control the brake force so that the brake force is increased when the measured time is shorter than a preset set time, and the brake force is reduced when the measured time is longer than the preset set time.

8. The fastener driving tool according to claim 7, wherein the position detection unit is configured to detect that the plunger has reached top dead center during the power supply to the motor by the motor drive control unit.

9. The fastener driving tool according to claim 4, further comprising:

a battery that supplies power to the fastener driving tool; and a battery voltage detection unit that detects a battery voltage as a supply voltage from the battery, wherein the motor drive control unit is configured to set the set time based on the battery voltage detected by the battery voltage detection unit.

10. The fastener driving tool according to claim 9, wherein the motor drive control unit is configured to prohibit setting of the set time based on the battery voltage and to hold a previous value as the set time when a driving interval of the driving target is shorter than a set interval.

11. A fastener driving tool comprising:

a plunger that configured to move in a driving direction;

an impact spring that biases the plunger in the driving direction;

a motor that receives power supply from a battery to rotate;

a drive mechanism that coupled to the motor and configured to move the plunger, by rotation of the motor, in a direction opposite to the driving direction, and configured to disengage the plunger when the plunger reaches top dead center;

a motor drive control unit that starts power supply to the motor in accordance with a received driving command, and then cuts off the power supply to the motor when the plunger moves to top dead center side through top dead center and bottom dead center; and a battery voltage detection unit that detects a battery voltage supplied from the battery to the motor, the motor drive control unit being configured to execute a stop position control for stopping the plunger in a predetermined stop position after the power supply to the motor is cut off, based on the battery voltage detected by the battery voltage detection unit.

12. The fastener driving tool according to claim 11, further comprises a position detection unit that detects that the plunger is positioned at top dead center, and wherein, in the stop position control, the motor drive control unit is configured to drive control the motor based on the battery voltage to stop the plunger at a predetermined stop position when the position detection unit detects that the plunger has reached top dead center.

13. The fastener driving tool according to claim 12, wherein, in the stop position control, the motor drive control unit is configured to control motor drive time from when the plunger reaches top dead center until the power supply to the motor is cut off to be shorter as the battery voltage is higher.

14. The fastener driving tool according to claim 11, wherein, in the stop position control, the motor drive control unit is configured to execute a free-run control for rotating the motor by inertia after the power supply to the motor is cut off, and control execution time of the free-run control based on the battery voltage.

15. The fastener driving tool according to claim 14, wherein, in the stop position control, the motor drive control unit is configured to control the execution time of the free-run control to be shorter as the battery voltage is higher.

16. The fastener driving tool according to claim 11, wherein, in the stop position control, the motor drive control unit is configured to execute a brake control for generating a brake force to the motor after the power supply to the motor is cut off, and controls a control amount of the brake control based on the battery voltage.

17. The fastener driving tool according to claim 16, wherein, in the stop position control, the motor drive control unit is configured to control the control amount of the brake control so that the brake force generated in the brake control increases as the battery voltage is higher.

18. The fastener driving tool according to claim 11, wherein the motor drive control unit is configured to execute the stop position control based on the battery voltage detected by the battery voltage detection unit before the power supply to the motor is started according to a received driving command.

19. The fastener driving tool according to claim 11, wherein the motor drive control unit is configured to execute the stop position control based on the battery voltage previously used in the stop position control when a driving interval of the driving target based on the driving command is shorter than a set interval.

* * * * *